US010212524B2

(12) United States Patent
Vandyke et al.

(10) Patent No.: US 10,212,524 B2
(45) **Date of Patent: *Feb. 19, 2019**

(54) WATERPROOF MOLDED MEMBRANE FOR MICROPHONE

(71) Applicant: COCHLEAR LIMITED, Macquarie University (AU)

(72) Inventors: James Vandyke, Macquarie University (AU); David Harte, Macquarie University (AU); Jan Patrick Frieding, Macquarie University (AU)

(73) Assignee: COCHLEAR LIMITED, Macquarie University (AU)

( * ) Notice: Subject to any disclaimer, the term of this patent is extended or adjusted under 35 U.S.C. 154(b) by 0 days.

This patent is subject to a terminal disclaimer.

(21) Appl. No.: 15/670,767

(22) Filed: Aug. 7, 2017

(65) Prior Publication Data

US 2017/0339498 A1 Nov. 23, 2017

Related U.S. Application Data

(63) Continuation of application No. 14/542,309, filed on Nov. 14, 2014, now Pat. No. 9,769,578.
(Continued)

(51) Int. Cl.
*H04R 25/00* (2006.01)
*H04R 1/08* (2006.01)

(52) U.S. Cl.
CPC ..... *H04R 25/60* (2013.01); *H04R 1/08* (2013.01); *H04R 1/083* (2013.01); *H04R 1/086* (2013.01); *H04R 25/604* (2013.01); *H04R 2225/77* (2013.01); *H04R 2410/07* (2013.01); *H04R 2499/11* (2013.01)

(58) Field of Classification Search
CPC ..... H04R 1/08; H04R 1/086; H04R 25/604; H04R 25/65; H04R 25/658; H04R 2225/021; H04R 2225/67; H04R 2410/01; H04R 2410/07; H04R 2499/11; H04R 25/60; H04M 1/03
USPC ..... 381/322, 324, 354, 355, 356, 359, 360, 381/361, 365, 368, 189; 181/149; 379/431, 433.02, 432
See application file for complete search history.

(56) References Cited

U.S. PATENT DOCUMENTS 4,434,329 A 2/1984 Nasu
4,953,215 A 8/1990 Weiss et al.
(Continued)

FOREIGN PATENT DOCUMENTS

CN 1551679 12/2004
CN 2909754 6/2007
(Continued)

OTHER PUBLICATIONS

PCT International Search Report and Written Opinion in International Application PCT/182015/001042, dated Oct. 29, 2015, 11 pages.

*Primary Examiner* — Huyen D Le
(74) *Attorney, Agent, or Firm* — Merchant & Gould P.C.

(57) ABSTRACT

A boot is used to cover an inlet of a microphone of an auditory prosthesis. The boot prevents water, sweat, and other debris from damaging the microphone or entering the prosthesis housing. Additionally, the boot can include structure that helps dampen vibrations within the auditory prosthesis, thus improving microphone performance.

21 Claims, 16 Drawing Sheets

Related U.S. Application Data

(60) Provisional application No. 61/955,656, filed on Mar. 19, 2014.

(56) References Cited

U.S. PATENT DOCUMENTS

| | | | | |
|---|---|---|---|---|
| 4,987,597 | A | 1/1991 | Haertl | |
| 5,204,907 | A * | 4/1993 | Staple | H04R 1/08 381/355 |
| 5,222,050 | A | 6/1993 | Marren et al. | |
| 5,613,011 | A | 3/1997 | Chase | |
| 5,748,743 | A | 5/1998 | Weeks | |
| 5,923,750 | A | 7/1999 | Enting | |
| 6,164,409 | A | 12/2000 | Berger | |
| 7,020,299 | B2 | 3/2006 | Niederdrank | |
| 7,751,579 | B2 | 7/2010 | Schulein et al. | |
| 7,793,756 | B2 | 9/2010 | Karamuk | |
| 8,144,112 | B2 | 3/2012 | Huang | |
| 8,150,082 | B2 | 4/2012 | Saito et al. | |
| 8,180,083 | B2 | 5/2012 | Campbell et al. | |
| 8,238,594 | B2 | 8/2012 | Sauer et al. | |
| 9,769,578 | B2 * | 9/2017 | Vandyke | H04R 25/60 |
| 2003/0125602 | A1 | 7/2003 | Sokolich | |
| 2005/0008173 | A1 | 1/2005 | Suzuki et al. | |
| 2011/0013799 | A1 | 1/2011 | Fang et al. | |
| 2011/0135127 | A1 | 6/2011 | Flaig et al. | |
| 2012/0093349 | A1 | 4/2012 | Chua et al. | |
| 2012/0163642 | A1 | 6/2012 | Dittle et al. | |
| 2013/0010992 | A1 | 1/2013 | Koester et al. | |
| 2015/0271610 | A1 | 9/2015 | Vandyke | |

FOREIGN PATENT DOCUMENTS

| | | |
|---|---|---|
| DE | 102010041656 | 10/2011 |
| DE | 102010041263 | 3/2012 |
| JP | 2006174005 | 6/2006 |
| JP | 2006186848 | 7/2006 |
| JP | 2007174488 | 7/2007 |
| WO | 2008154954 | 12/2008 |
| WO | 2012082320 | 6/2012 |
| WO | 2012099756 | 7/2012 |
| WO | WO2013091724 | 6/2013 |
| WO | 2015140645 | 9/2015 |

* cited by examiner

WATERPROOF MOLDED MEMBRANE FOR MICROPHONE

CROSS-REFERENCE TO RELATED APPLICATIONS

This application is a continuation of U.S. application Ser. No. 14/542,309 filed Nov. 14, 2014, entitled, "WATERPROOF MOLDED MEMBRANE FOR MICROPHONE," now U.S. Pat. No. 9,769,578, which claims priority to and the benefit of U.S. Provisional Patent Application No. 61/955,656, filed Mar. 19, 2014, entitled "WATERPROOF MOLDED MEMBRANE FOR MICROPHONE," the disclosures of these applications are incorporated by reference herein in their entirety.

BACKGROUND

The microphones of external portions of auditory prostheses are both highly sensitive and very fragile. As such, the microphones require protection from external elements that take the form of dirt, dust, sweat, water, and other substances that may be present in a given environment. A semi-water permeable filter may be utilized that provides a degree of resistance to substance ingress while allowing for the passage of air to a sound inlet of the microphone. However, such a solution is not able to withstand vigorous aquatic activities or other events such as significant rain, bathing, swirling dust, etc. Under such extreme circumstances, substances may be able to penetrate the membrane and can permanently degrade or destroy the microphone, rendering the device ineffective.

SUMMARY

Embodiments disclosed herein relate to devices that are used to provide a waterproof enclosure for a microphone or other sound-receiving component of an auditory prosthesis. The sound-receiving components include, but are not limited to, microphones, transducers, MEMS microphones, and so on. Example auditory prostheses include, for example, cochlear implants, hearing aids, bone conduction devices, or other types of devices. A boot manufactured of silicone or other appropriate material is sized to fit around the sound-receiving component. The face of the boot can be manufactured to surround the microphone without stretching, which can have an adverse effect on the sound received at the microphone. The boot can include a flange or other structure to help secure the boot into the auditory prosthesis housing, while reducing vibration transmission between the housing and the microphone.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

BRIEF DESCRIPTION OF THE DRAWINGS

The same number represents the same element or same type of element in all drawings.

DETAILED DESCRIPTION

The technologies disclosed herein can be used in conjunction with various types of auditory prostheses, including active transcutaneous bone conduction devices, passive transcutaneous devices, middle ear devices, cochlear implants, and acoustic hearing aids. In general, any type of auditory prosthesis that utilizes a microphone, transducer, or other sound-receiving component may benefit from the technologies described herein. Additionally, the technologies may be incorporated into other devices that receive sound and send a corresponding stimulus to a recipient. The corresponding stimulus may be in the form of electrical signals, mechanical vibrations, or acoustic sounds. Additionally, the technology can be used in conjunction with other components of an auditory prosthesis. For example, the technologies can be utilized with sound processing components, speakers, or other components that can benefit from protection from water or debris, or from vibration isolation. For clarity, however, the technologies disclosed herein will be generally described in the context of microphones used in behind-the-ear auditory prostheses, used in conjunction with a cochlear implant.

Figure 1:
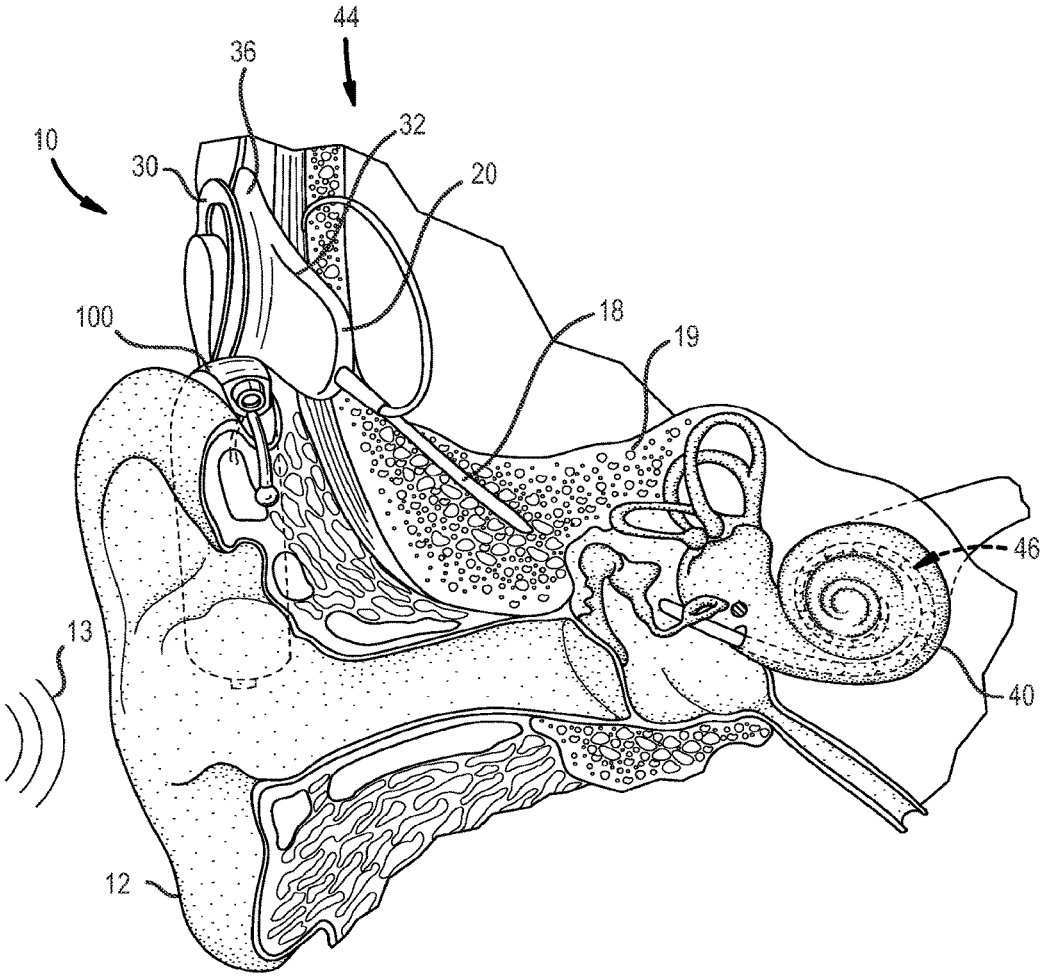
FIG. 1 is a partial view of a behind-the-ear auditory prosthesis worn on a recipient.

Referring to FIG. 1, cochlear implant system 10 includes an implantable component 44 typically having an internal receiver/transceiver unit 32, a stimulator unit 20, and an elongate lead 18. The internal receiver/transceiver unit 32 permits the cochlear implant system 10 to receive and/or transmit signals to an external device 100 and includes an internal coil 36, and preferably, a magnet (not shown) fixed relative to the internal coil 36. These signals generally correspond to external sound 13. Internal receiver unit 32 and stimulator unit 20 are hermetically sealed within a biocompatible housing, sometimes collectively referred to as a stimulator/receiver unit. The magnets facilitate the operational alignment of the external and internal coils, enabling internal coil 36 to receive power and stimulation data from external coil 30. The external coil 30 is contained within an external portion 50 such as the type depicted in FIG. 1A. Elongate lead 18 has a proximal end connected to stimulator unit 20, and a distal end implanted in cochlea 40. Elongate lead 18 extends from stimulator unit 20 to cochlea 40 through mastoid bone 19.

In certain examples, external coil 30 transmits electrical signals (e.g., power and stimulation data) to internal coil 36 via a radio frequency (RF) link, as noted above. Internal coil 36 is typically a wire antenna coil comprised of multiple turns of electrically insulated single-strand or multi-strand platinum or gold wire. The electrical insulation of internal coil 36 is provided by a flexible silicone molding. Various types of energy transfer, such as infrared (IR), electromagnetic, capacitive and inductive transfer, can be used to transfer the power and/or data from external device to cochlear implant.

There are a variety of types of intra-cochlear stimulating assemblies including short, straight and peri-modiolar. Stimulating assembly 46 is configured to adopt a curved configuration during and or after implantation into the recipient's cochlea 40. To achieve this, in certain arrangements, stimulating assembly 46 is pre-curved to the same general curvature of a cochlea 40. Such examples of stimulating assembly 46, are typically held straight by, for example, a stiffening stylet (not shown) or sheath which is removed during implantation, or alternatively varying material combinations or the use of shape memory materials, so that the stimulating assembly can adopt its curved configuration when in the cochlea 40. Other methods of implantation, as well as other stimulating assemblies which adopt a curved configuration, can be used.

Stimulating assembly can be a pcrimodiolar, a straight, or a mid-scala assembly. Alternatively, the stimulating assembly can be a short electrode implanted into at least in basal region. The stimulating assembly can extend towards apical end of cochlea, referred to as cochlea apex. In certain circumstances, the stimulating assembly can be inserted into cochlea via a cochleostomy. In other circumstances, a cochleostomy can be formed through round window, oval window, the promontory, or through an apical turn of cochlea.

Figure 1A:
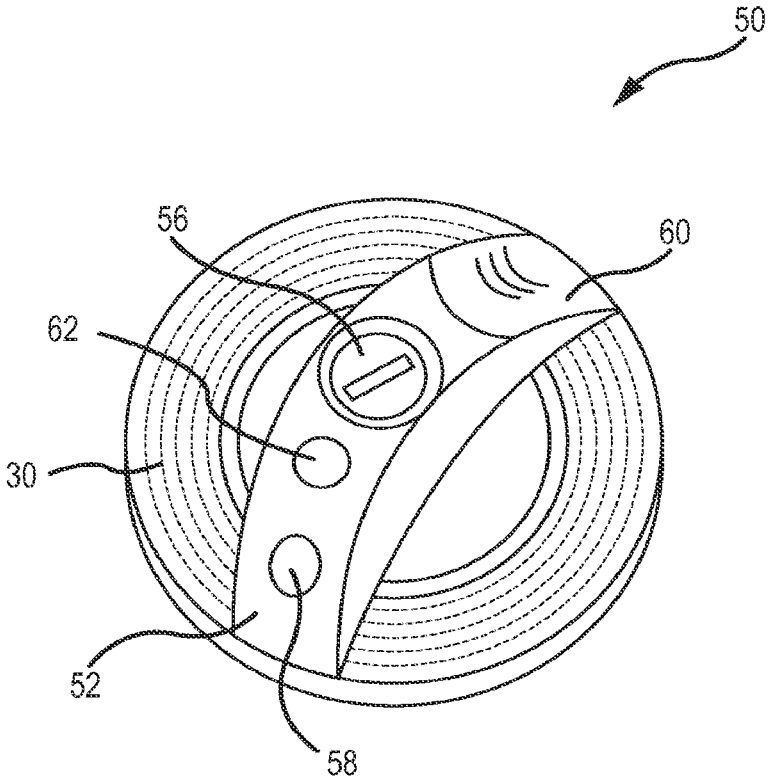
FIG. 1A is a side perspective view of an external portion of the auditory prosthesis of FIG. 1.

FIG. 1A is a perspective view of an embodiment of an external portion 50 of an auditory prosthesis. The external portion 50 includes a body 52 and the external coil 30 connected thereto. The function of the external coil 30 is described above with regard to FIG. 1. The body 52 can include a permanent magnet 56 as described above, which helps secure the external portion 50 to the recipient's skull. The external portion 50 can include an indicator 58 such as a light emitting diode (LED). A battery door 60 covers a receptacle that includes a battery that provides internal power to the various components of the external portion 50 and the implantable portion. A microphone 62 receives sound that is processed by components within the external portion 50.

Figure 1B:
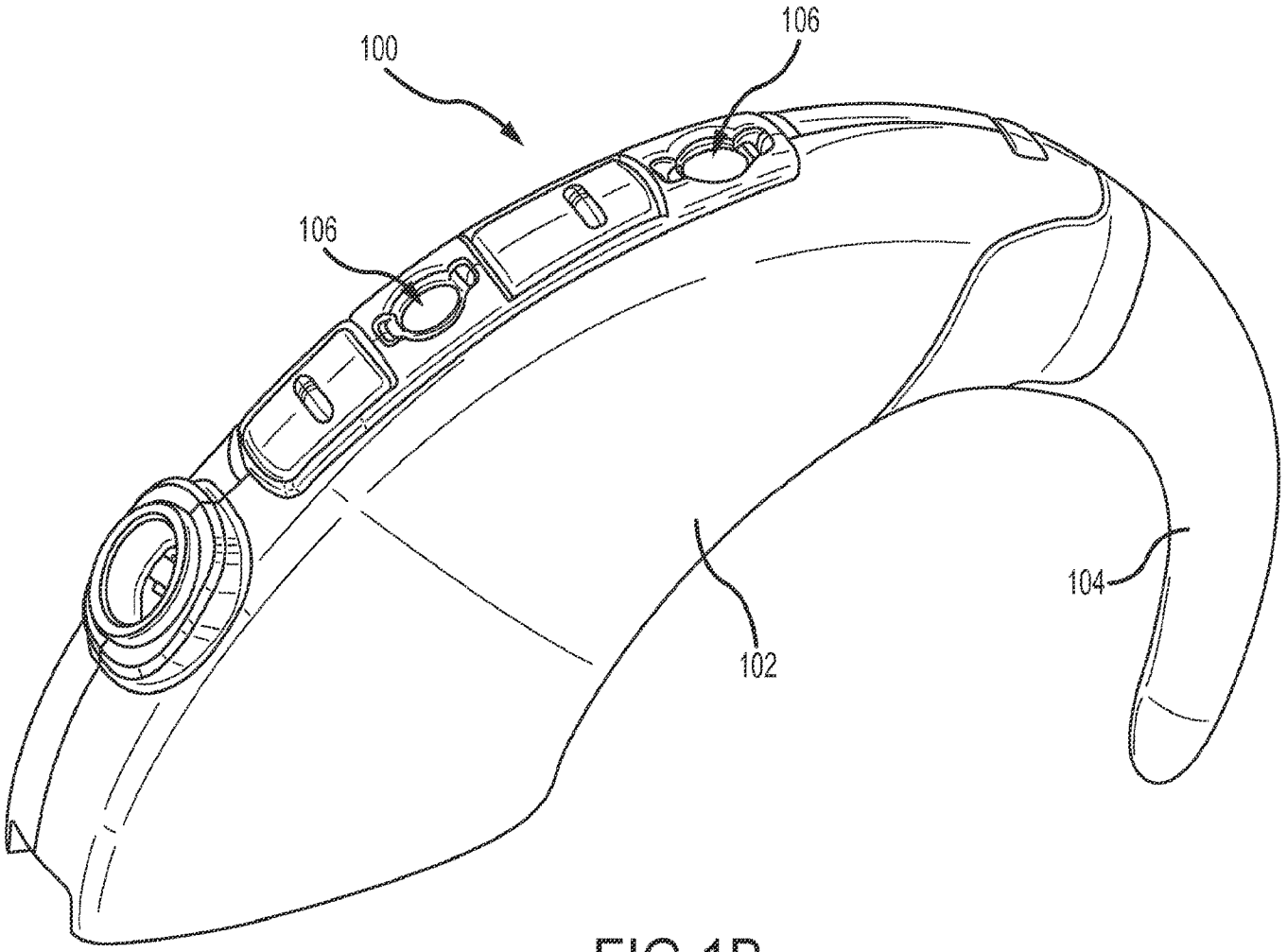
FIG. 1B is a side perspective view of another external portion of the auditory prosthesis of FIG. 1.

FIG. 1B depicts another embodiment of an external portion 100 of an auditory prosthesis. The external portion 100 includes a housing 102 and an ear hook 104 extending therefrom to help secure the external portion 100 to the ear of a recipient. The ear hook 104 helps secure the external portion 100 to a recipient. More specifically, the ear hook 104 wraps around the upper portion of an ear of the recipient. The housing 102 of the external portion 100 defines one or more openings 106 that allow sound to travel into the housing 102, to a microphone or other sound-receiving element disposed therein. These openings 106 form a penetration in the housing 102 that may allow water, dirt, or other debris to enter the housing 102. Such ingress may damage the microphone and/or other elements within the housing 102. In the depicted embodiment, the openings 106 are depicted as round in shape, but openings having other shapes are contemplated. The technologies described herein are described in the context of microphones utilized in the external portion 100 that is worn on the ear of a recipient. However, since the external portion 50 described above also includes a microphone, the technologies described herein are equally applicable to microphones utilized in such external portions that attach to a recipient's skull.

Figure 2:
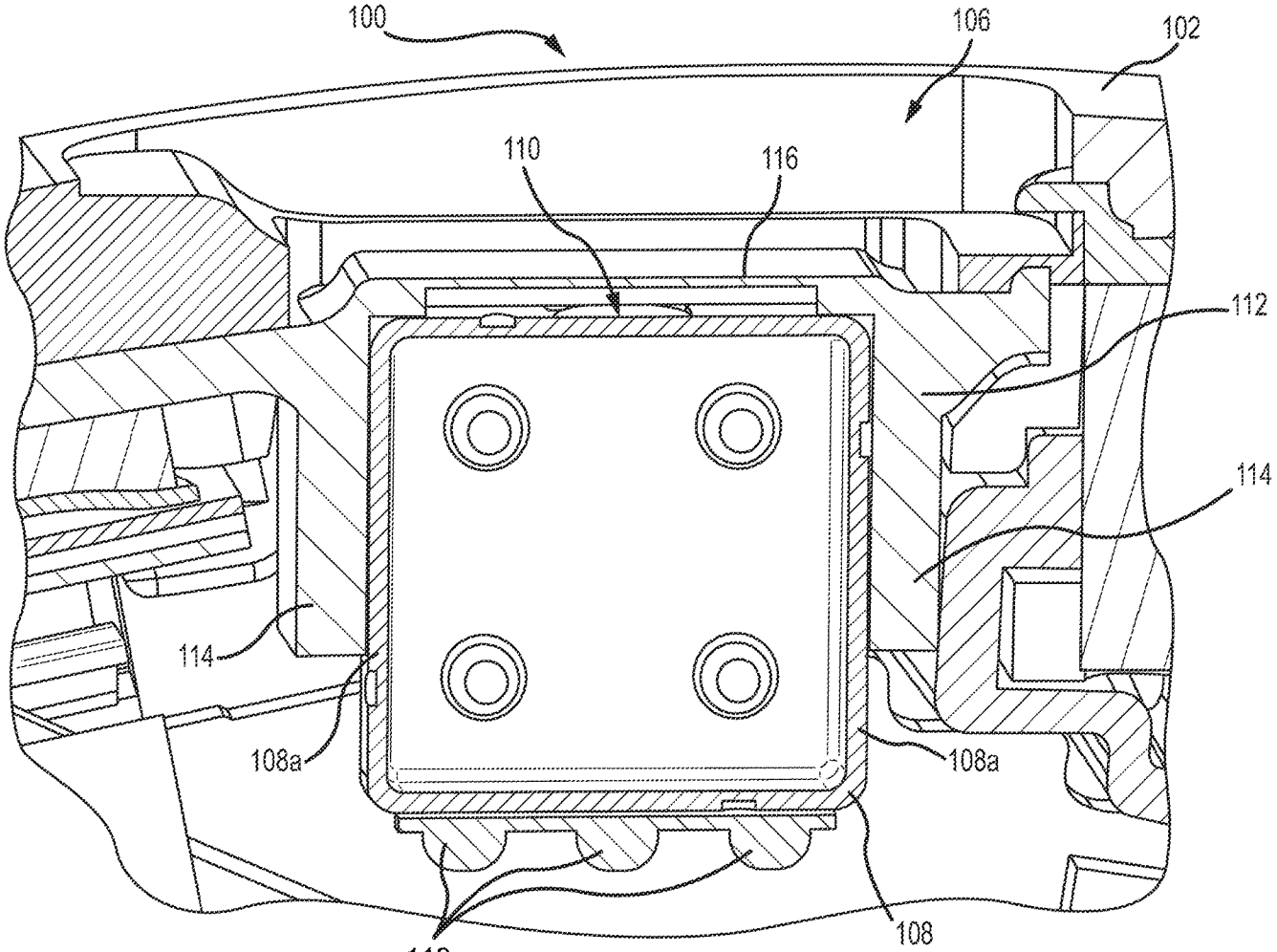
FIG. 2 is a partial side sectional view of the external portion of FIG. 1B.

FIG. 2 is a partial side sectional view of the external portion 100 of an auditory prosthesis. A microphone 108 is located within the housing 102 proximate the opening 106 defined by the housing 102. The microphone 108 includes a plurality of walls 108*a* and a microphone inlet 110 oriented proximate the opening 106. Sound is received at the microphone inlet 110, and processed by via internal components of the auditory prosthesis 100. An output signal is then sent to the recipient. The output signal may be one or more of a vibration, amplified sound, electrical signal, etc., depending on the type of auditory prosthesis.

A boot 112 receives and substantially surrounds the microphone 108 with a plurality of sidewalls 114 that form a sleeve into which the microphone 108 fits. The sleeve is sized so as to form a friction fit between the sidewalls 114 and the microphone 108. The friction fit between the sidewalls 108 of the boot 112 and the walls 108*a* of the microphone 108 prevents the microphone 108 from sliding out of the sleeve. In other embodiments, an adhesive between the walls 108*a* and the sidewalls 114 may be utilized. The boot 112 also includes a face 116 that spans the sidewalls 114 at one end of the sleeve. The face 116 is disposed proximate the microphone inlet 110. The disposition of the face 116 protects the microphone 108 from ingress of water, debris, and other contaminants. The structural aspects of various boots are described below. Additionally, other structural aspects of the boot 112 prevent ingress of contaminants into the interior of the housing 102, which could damage other components. Thus, the boots described herein can be used to completely close off the openings 106, thus forming a fully water-tight auditory prosthesis, without adversely effecting sound transmission to the critical components (e.g., the microphone). Additionally, boots can be manufactured to surround a microphone having any required or desired outer dimensions or shape. For example, boots having a substantially cylindrical shape (and therefor, a single sidewall) can be utilized with microphones having a substantially cylindrical shape.

The boot 112 holds the microphone 108 and helps isolate that component from vibrations present within the housing 102. Such vibrations may be due to contact between the housing and the skin or hair of the recipient, contact with accessories such as scarves or hats, or other environmental factors. The boot 112 effectively suspends the microphone within the housing 102 and, since it is manufactured of silicone or other resilient material, the boot 112 dampens any vibrations occurring therein that may have an adverse effect on the microphone 108. Solder points 119 on the microphone 108 are connected to flexible wires that deliver signals to and from the microphone 108 to sound processing or other components. These flexible wires further prevent vibrations from having an adverse effect on the microphone 108.

Figure 3:
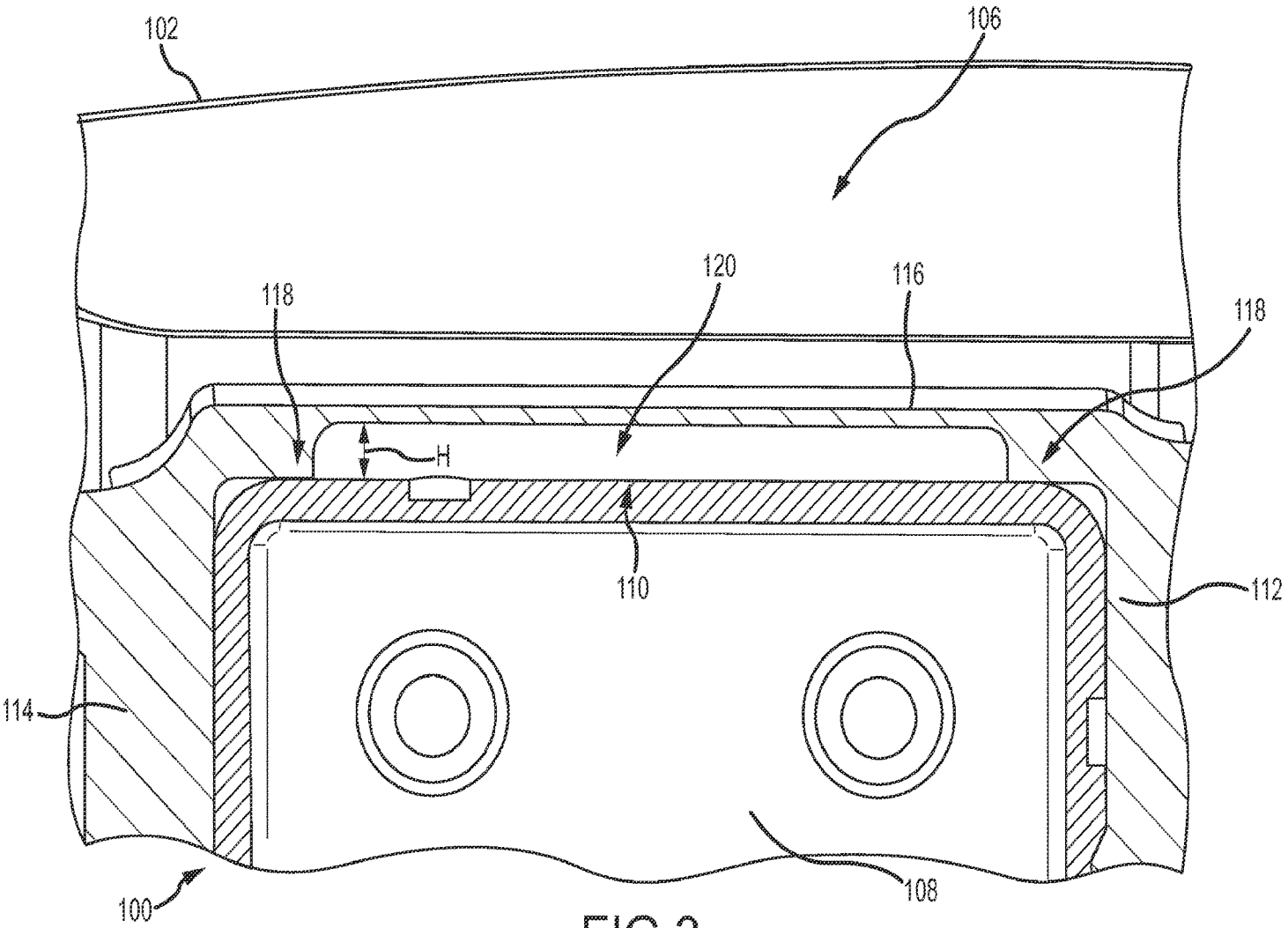
FIG. 3 is an enlarged partial side sectional view of the external portion of FIG. 2.

FIG. 3 is an enlarged partial side sectional view of the external portion 100, as depicted in FIG. 2. Several elements depicted in FIG. 3 are described above with regard to FIG. 2 and thus are not further described here. The boot 112 includes one or more spacers 118 disposed proximate the intersection of the sidewalls 114 and the face 116. In the depicted embodiment, the spacers 118 are disposed proximate two of the four sidewalls 114. In other embodiments, the spacers may be disposed about the entire perimeter of the face 116. Regardless, the spacers 118 form a stop that prevents further insertion of the microphone 108 once the microphone 108 contacts the spacers 118. Once the microphone 108 is inserted to a maximum depth, the spacer 118 creates a cavity 120 having a height H defined by the microphone inlet 110 (in contact with the spacer 118) and the face 116. In certain embodiments, the height H may be between about 0.1 mm and about 0.3 mm. In certain embodiments, a height of about 0.2 mm may be particularly desirable. Test results comparing various cavity heights H are described relative to FIGS. 8A and 8B. The height H of the cavity 120 prevents contact between the face 116 and the microphone inlet 110 as the face 116 vibrates and moves due to sound waves impacting the face 116. Contact between the microphone inlet 110 and the face 116 may cause adverse sounds to be transmitted to the microphone 108.

Figure 4A:
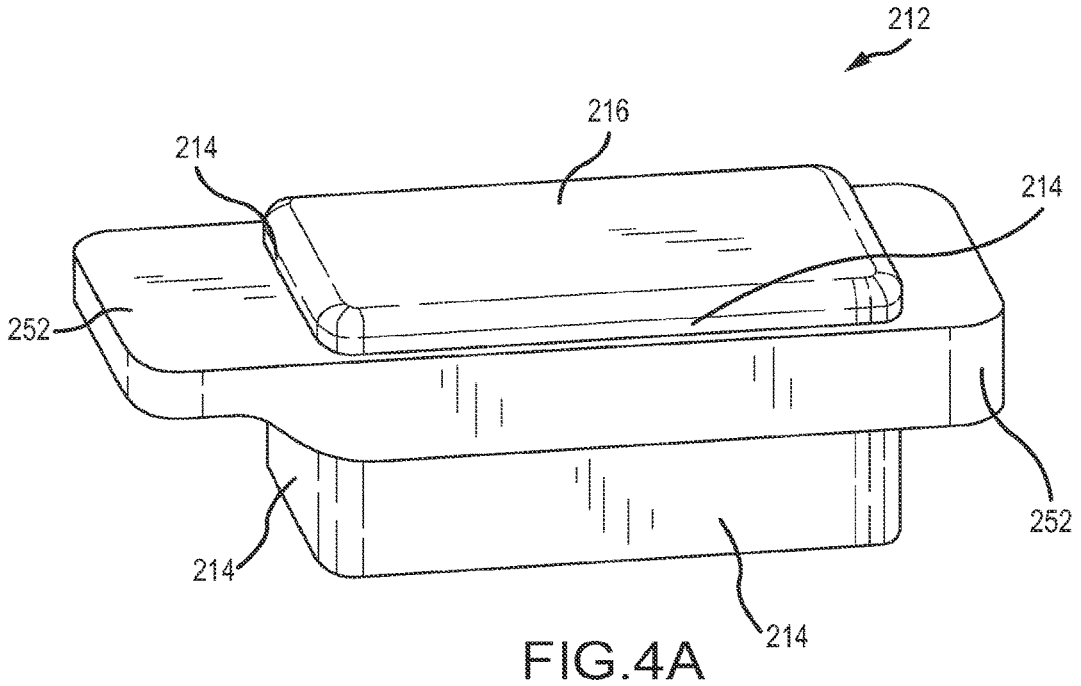
FIGS. 4A and 4B are perspective and perspective sectional views, respectively, of one embodiment of a boot for use in an auditory prosthesis.
Figure 4B:
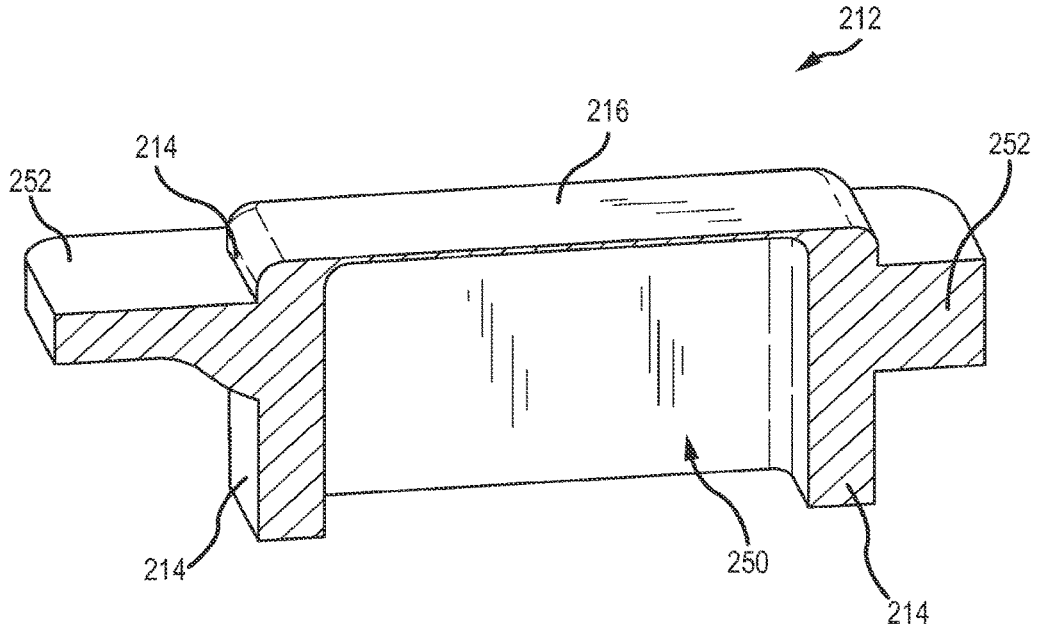

FIGS. 4A and 4B are perspective and perspective sectional views, respectively, of one embodiment of a boot 212 for use in an auditory prosthesis. These figures are described together. Similar to the boot 112 described above, the boot 212 of FIGS. 4A and 4B includes sidewalls 214 forming a sleeve and a face 216 spanning the sidewalls 214 proximate one end of the sleeve. The sleeve defines an interior 250 for receiving a microphone or other components. The boot 212 also includes at least one flange 252. In the boot 212, the flange 252 extends from the each of the four sidewalls 214, but in other embodiments, the flange can extend from fewer than four of the sidewalls 214. Flanges that extend from opposing sidewalls can be particularly advantageous, since they help balance the position of the boot 212 within the housing of the auditory prosthesis. The flanges 252 are disposed proximate corresponding structure within the housing to secure the boot 212 in place. For example, flanges 252 can be pinched between two or more holding structures within the housing of the auditory prosthesis, so as to hold the boot 212 in place. Additionally, flanges 252 that extend around the full perimeter of the sleeve enable a complete sealing of the associated opening in the housing. Since the boot 212 is made of a resilient material, vibrations passing though the auditory prosthesis (e.g., via the associated holding structures) will be damped by the boot 212.

Figure 5A:
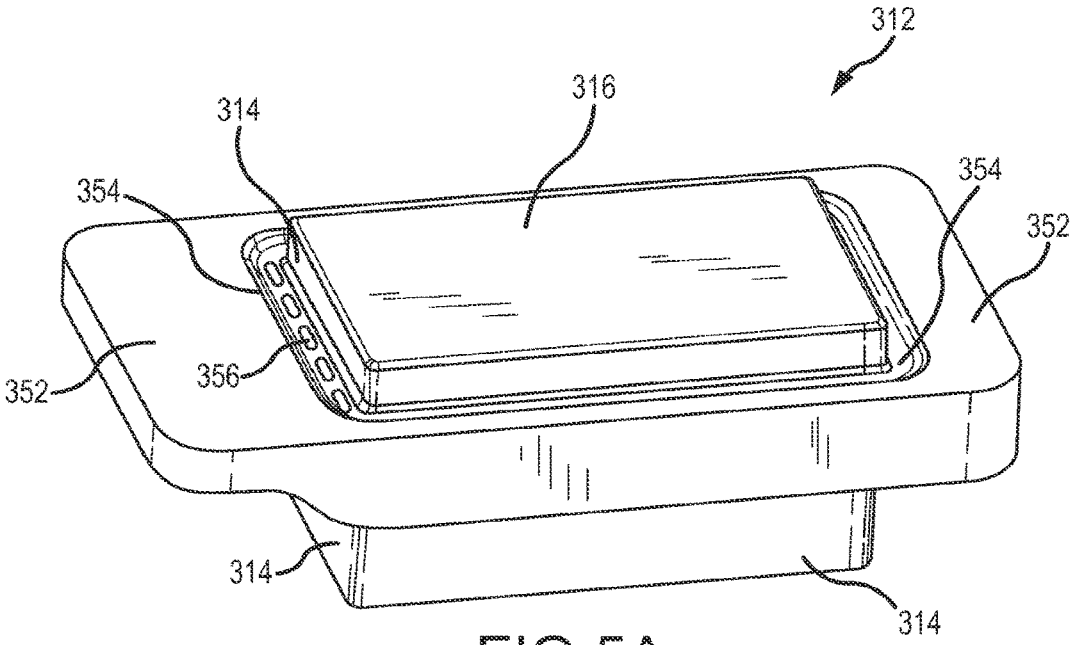
FIGS. 5A and 5B are perspective and perspective sectional views, respectively, of another embodiment of a boot for use in an auditory prosthesis.
Figure 5B:
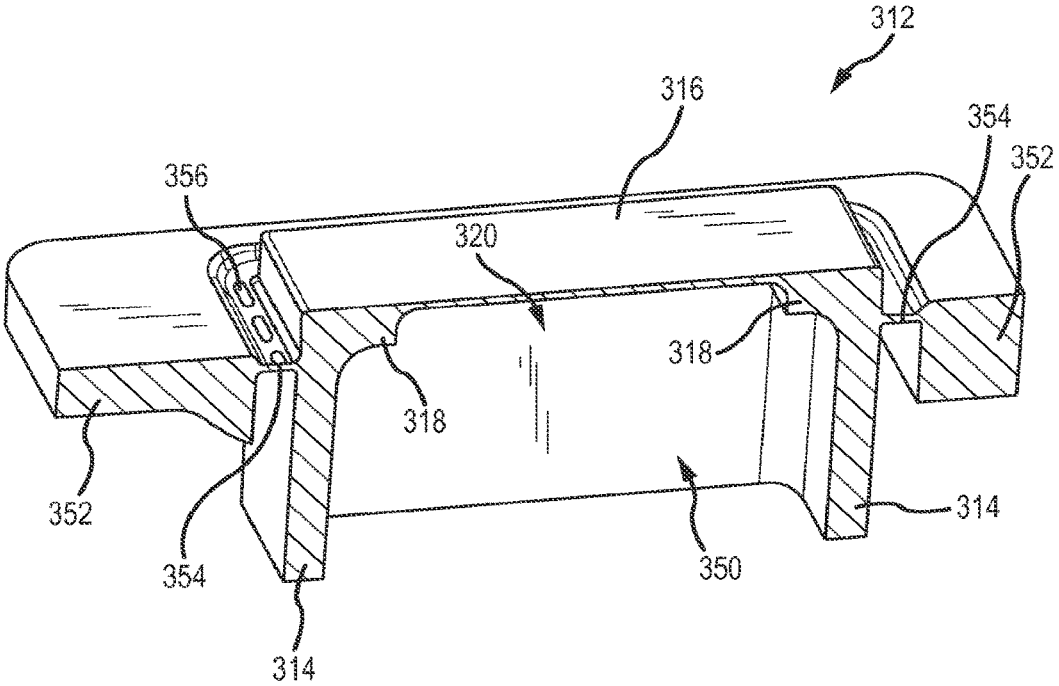
Figure 10:
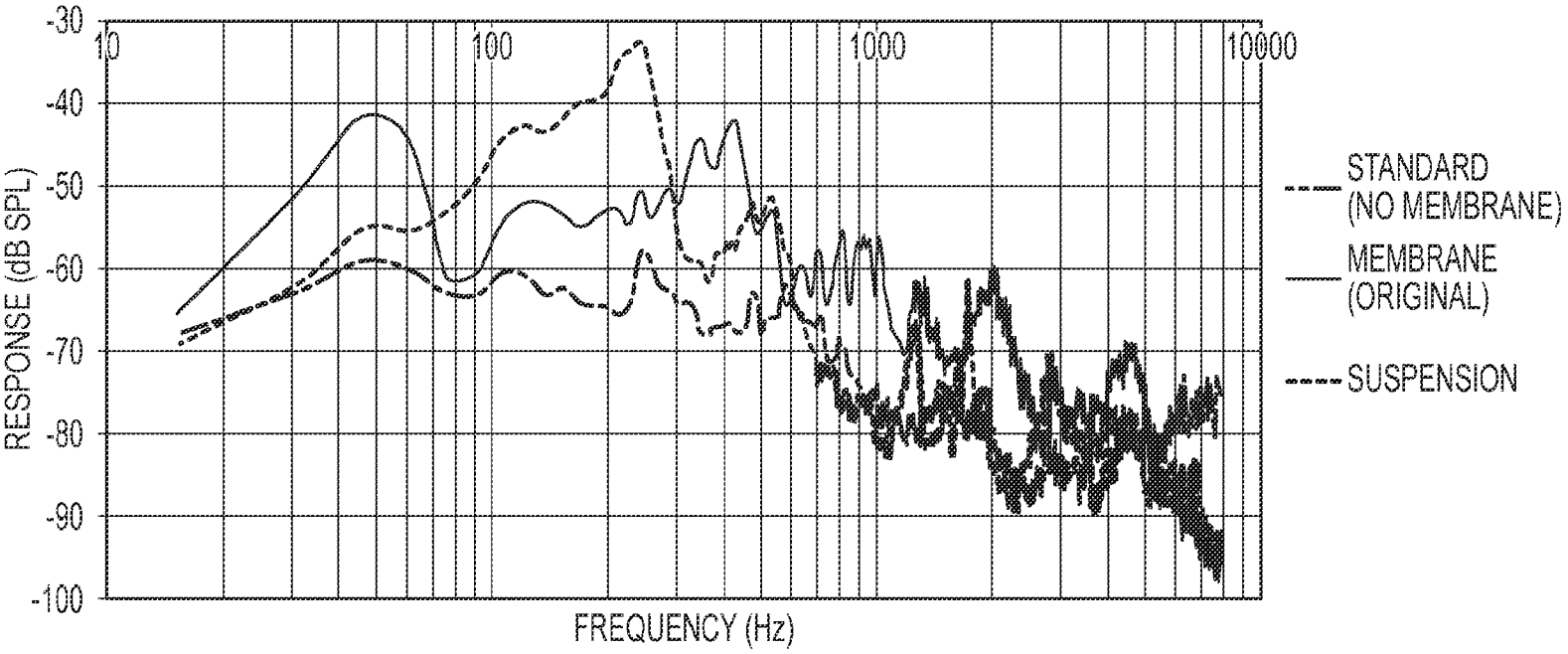
FIG. 10 depicts a comparison plot of frictional noise differences between boots having differing structures.

FIGS. 5A and 5B are perspective and perspective sectional views, respectively, of another embodiment of a boot 312 for use in an auditory prosthesis. These figures are described together. Similar to the boots described above, the boot 312 of FIGS. 5A and 5B includes sidewalls 314 forming a sleeve and a face 316 spanning the sidewalls 314 proximate one end of the sleeve. Spacers 318 are utilized to form a cavity 320 when a microphone is completely inserted into the sleeve interior 350. The flanges 352 are utilized as described above to support the microphone and reduce the adverse effects of vibrations. In the depicted boot 312, the flanges 352 are connected to the sidewalls 314 at a collar 354. The collar 354, in this embodiment, is a portion of boot material thinner than the flange 352 and/or the sidewall 314. The collar 354 helps further dampen vibrations within the auditory prosthesis. The collar 354 can be solid or can define a number of openings 356 to further reduce vibration transmission. Test results comparing collared boots (e.g., FIGS. 4A and 4B) versus non-collared boots (e.g., FIGS. 5A and 5B) are depicted in FIG. 10.

Figure 6A:
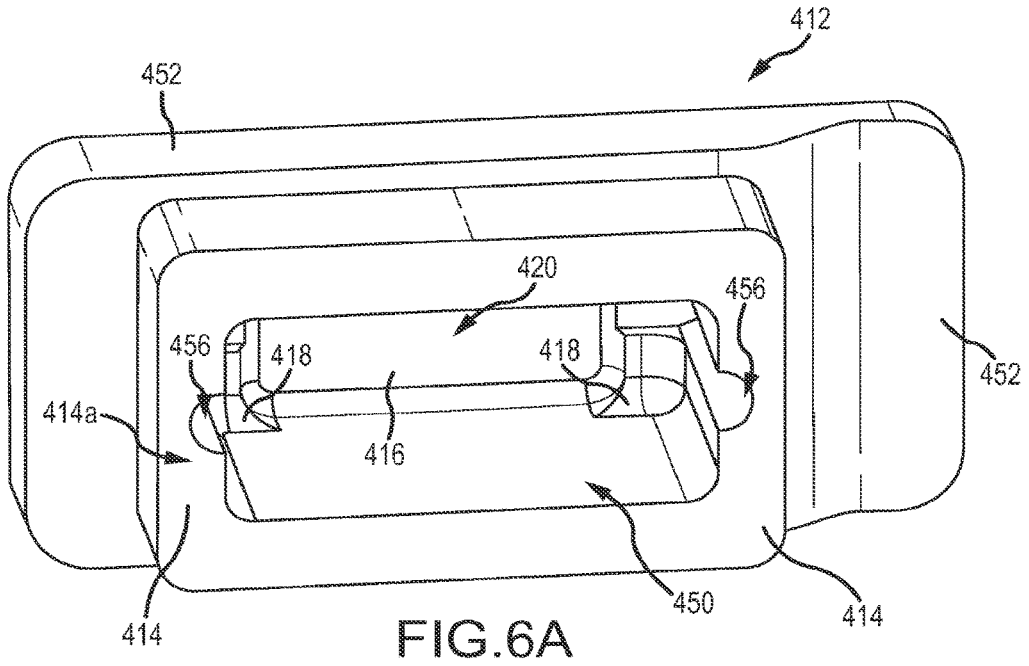
FIGS. 6A and 6B are bottom perspective and side perspective sectional views, respectively, of another embodiment of a boot for use in an auditory prosthesis.
Figure 6B:
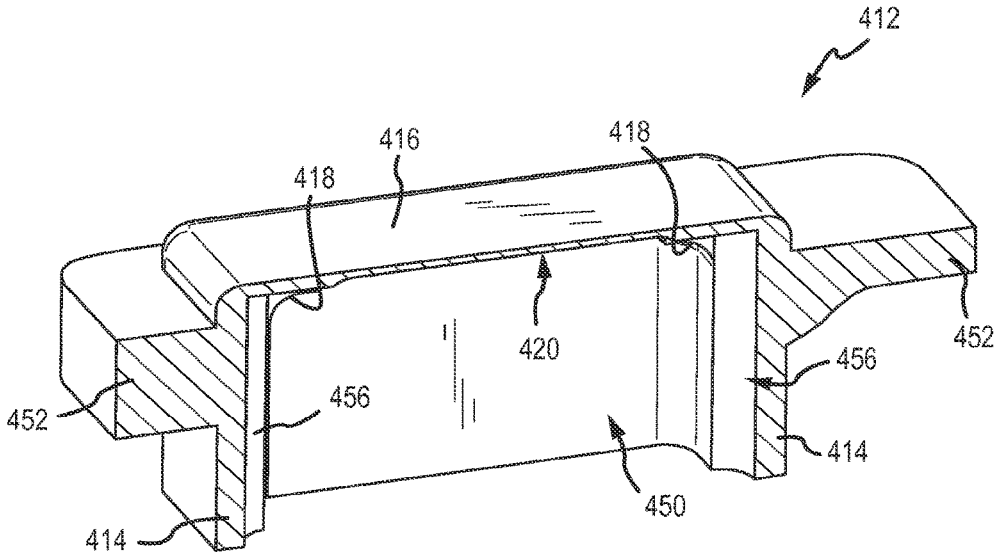
Figure 6C:
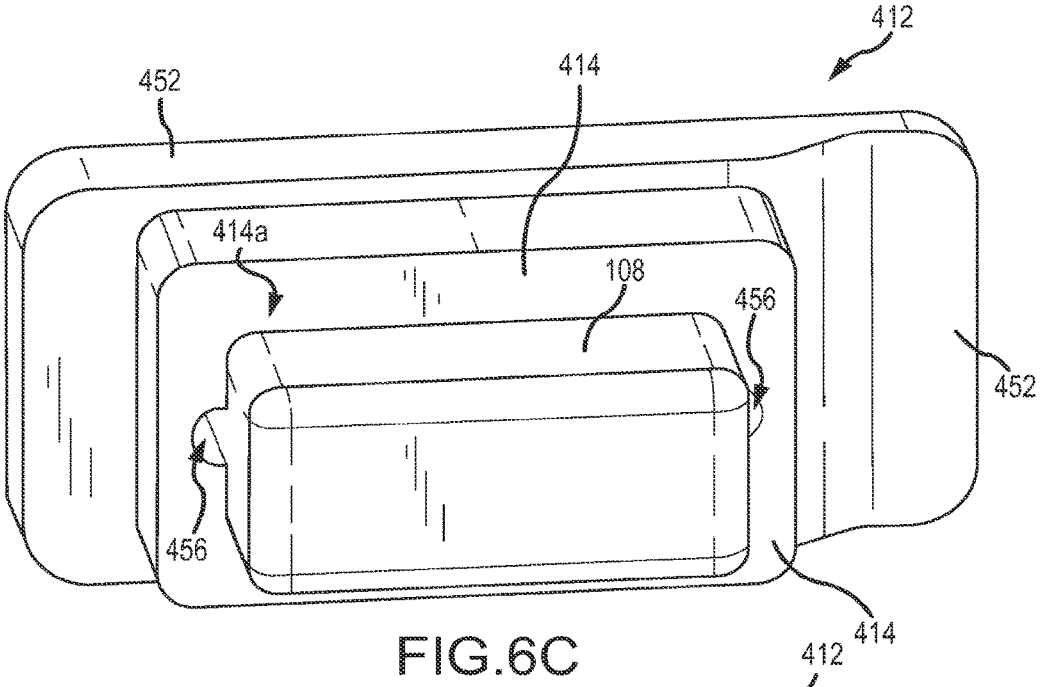
FIGS. 6C and 6D are bottom perspective and side perspective sectional views, respectively, of the boot of FIGS. 6A and 6B, containing a microphone.
Figure 6D:
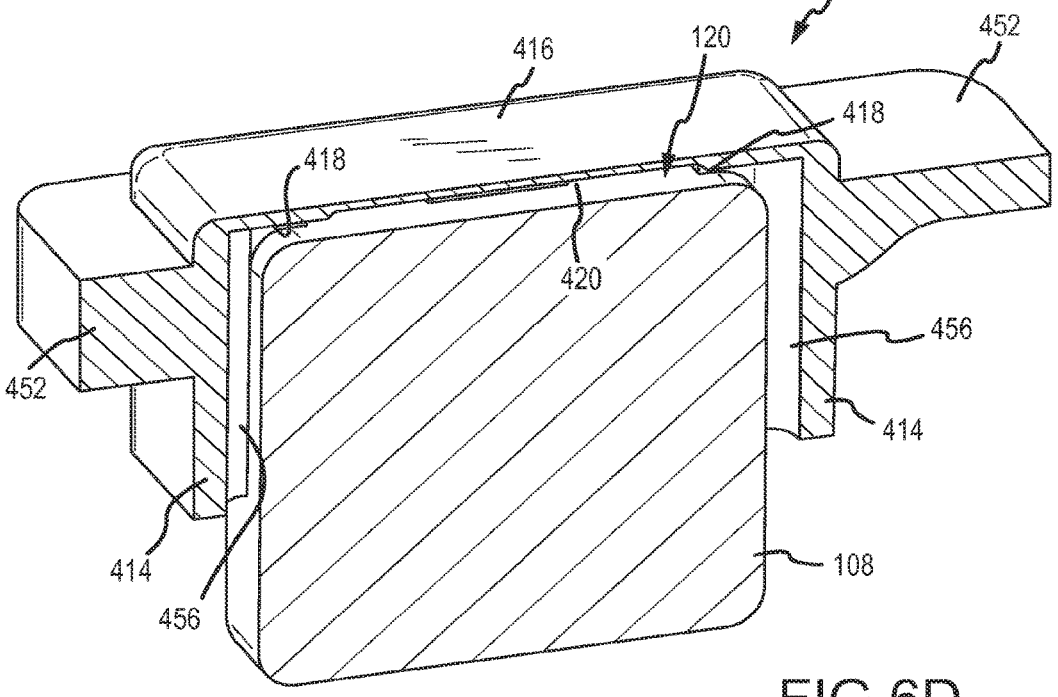
Figure 9:
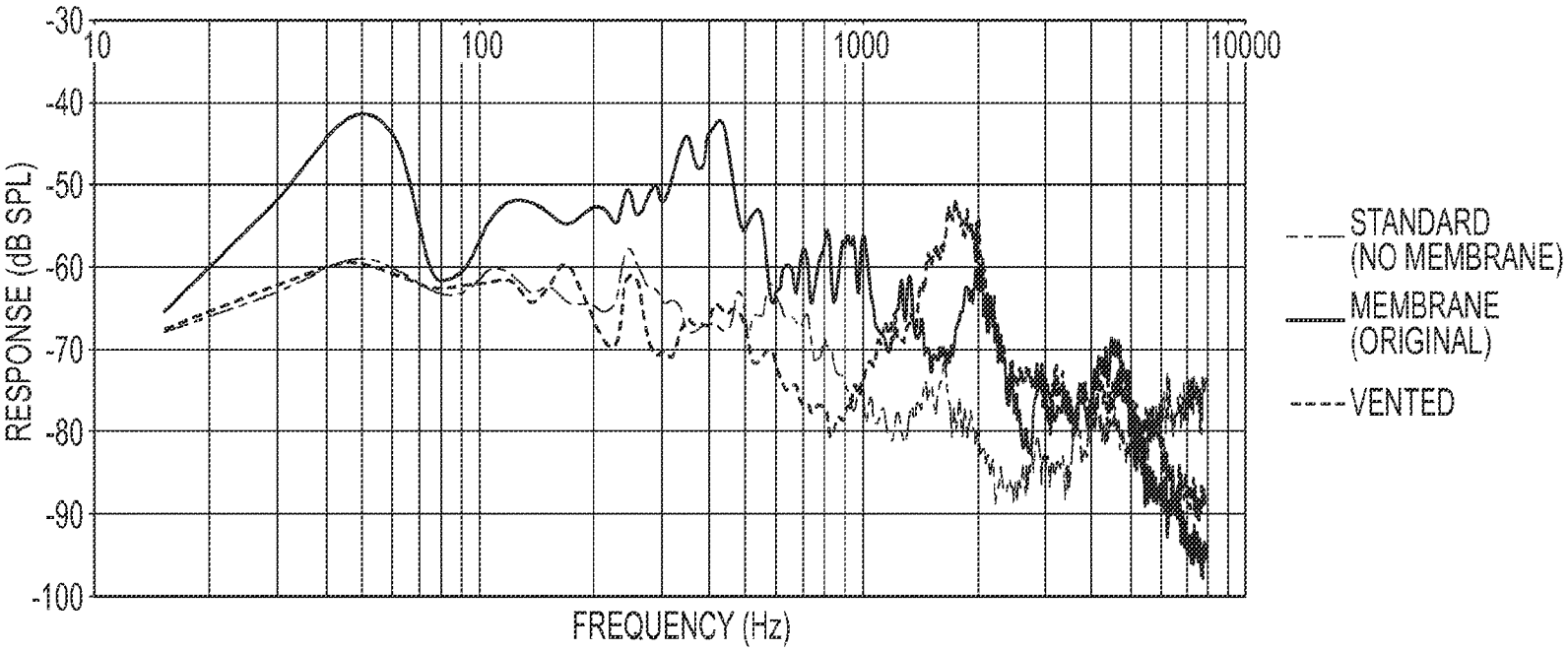
FIG. 9 depicts a comparison plot of frictional noise reduction between boots having differing structures.

FIGS. 6A and 6B are bottom perspective and side perspective sectional views, respectively, of another embodiment of a boot 412 for use in an auditory prosthesis. These figures are described together with FIGS. 6C and 6D, which depict the boot 412 containing a microphone 108. Similar to the boots described above, the boot 412 of FIGS. 6A-6D includes sidewalls 414 forming a sleeve and a face 416 spanning the sidewalls 414 proximate one end of the sleeve. Spacers 418 are utilized to form a cavity 420 when the microphone 108 is completely inserted into the sleeve interior 450. One or more sidewalls 414 at least partially or completely define one or more channels 456. The channels 456 are in fluidic communication with both the cavity 420 and the interior of the housing of the auditory prosthesis, since they penetrate a surface of the sidewalls 414. In this embodiment, the channels 456 penetrate a bottom surface 414*a*, but in other embodiments, other surfaces may be penetrated. The channels 456 provide attuned relief venting from the cavity 420 as sound waves are transmitted from the face 416 through the cavity 420 and to the microphone 108. The channels 456 can be sized as required or desired for a particular application. For example, channels 456 having a cross sectional area of about 0.4 $mm^2$ have been discovered to improve performance for sound frequencies up to about 8 kHz, when utilized in an auditory prosthesis such as a cochlear implant. Test results comparing attenuated relief vented boots (e.g., FIGS. 6A-6D), and non-vented boots (e.g., FIGS. 4A-5B) are depicted in FIG. 9. In alternative embodiments, back venting may be utilized with the cavity. Back venting utilizes a defined closed volume significantly larger than the volume of the cavity at the face of the microphone.

Figure 7A:
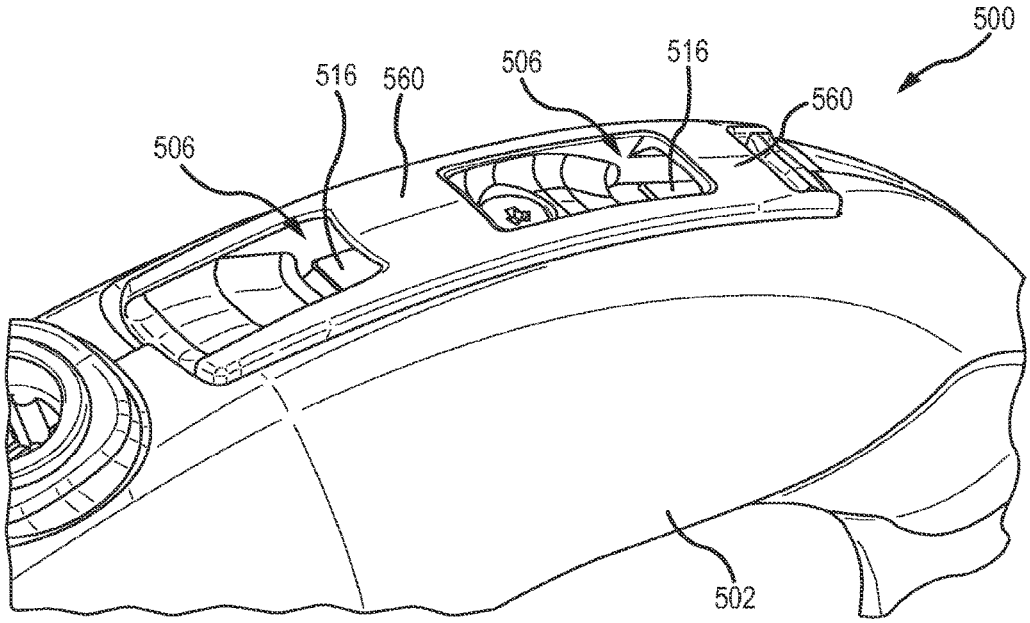
FIGS. 7A and 7B are partial perspective and partial perspective sectional views, respectively, of another embodiment of an external portion of an auditory prosthesis.
Figure 7B:
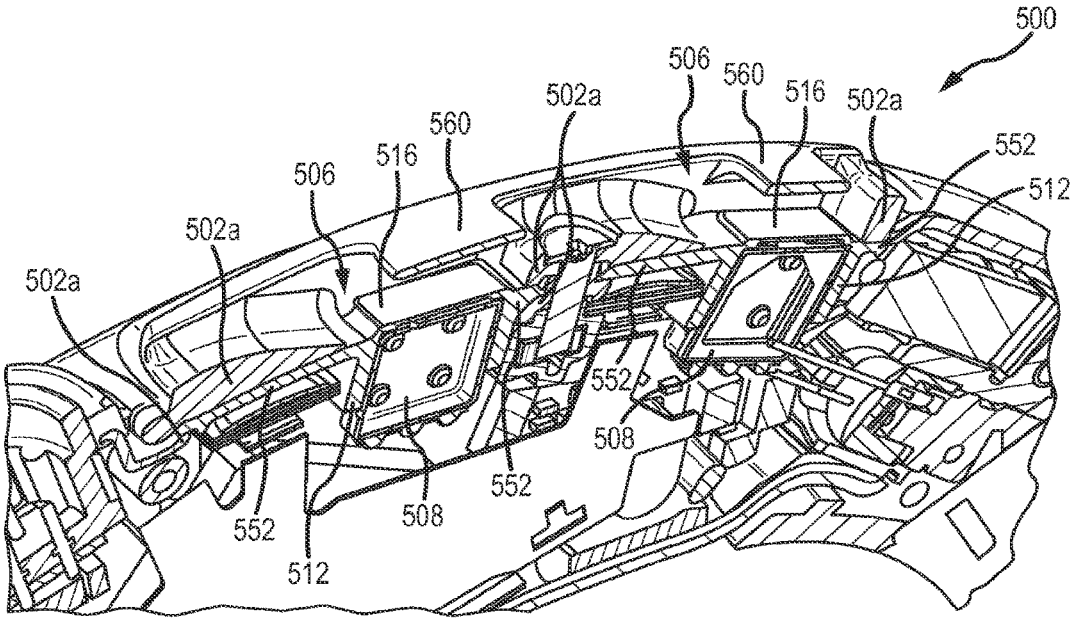

FIGS. 7A and 7B are partial perspective and partial perspective sectional views, respectively, of another embodiment of an external portion 500, and are described together. In the embodiment, the external portion 500 utilizes two microphones 508 in a housing 502. Boots 512 are utilized to contain and support the microphones 508 as described herein. Boot flanges 512 are held between structural elements 502*a* of the housing 502 to further isolate the microphones 508 from vibration as well as to seal the openings 506 against contaminant ingress. Not all structural elements 502*a* are depicted in FIGS. 7A and 7B. Various sizes, types, and locations of structural elements are contemplated. Faces 516 of each boot 508 are disposed above the microphones 508 and are located proximate openings 506 in the housing 502. To protect the faces 516 from possible puncture or contact with large debris, the housing 502 includes a guard 516 over each face 516. The guard 560 is spaced from the face 516 a distance sufficient to enable unattenuated sound waves to enter the opening 506 and contact the face 516. In other embodiments, the guard may be a robust mesh or screen that allows for the entry of sound waves.

Figure 8A:
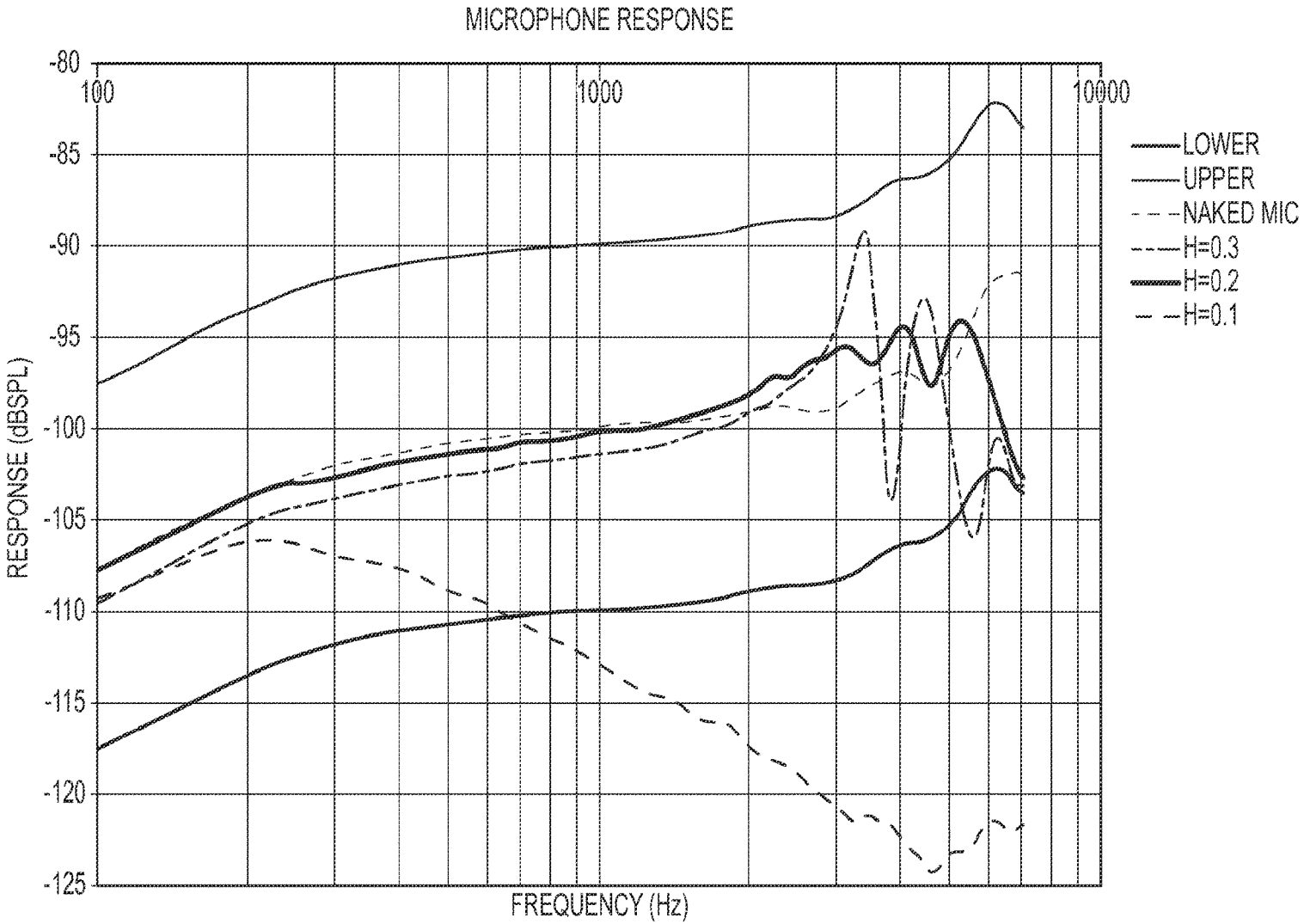
FIGS. 8A and 8B depict comparison plots of microphone frequency responses for various cavity heights.
Figure 8B:
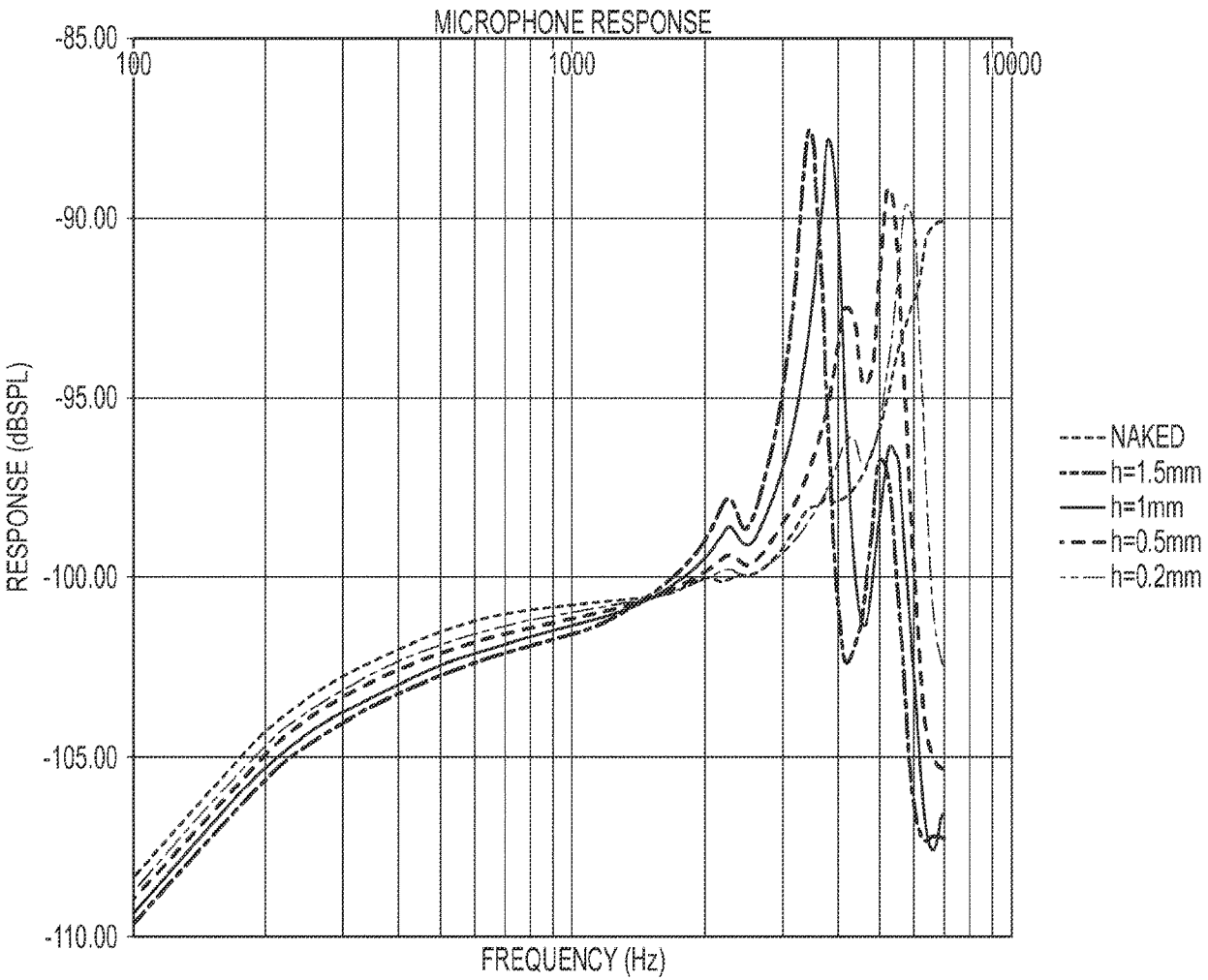

FIGS. 8A and 8B depict comparison plots of microphone frequency responses for various cavity heights. The plot of FIG. 8A depicts tested results for microphones that are typically used in auditory prostheses, for example, in cochlear implants. In the plot, the upper curve depicts upper test system limits (i.e., the upper end of an allowed response for production devices), while the lower curve depicts lower test system limits (i.e., the lower end of an allowed response for production devices). The response for a naked microphone (e.g., a microphone not covered by a boot) is depicted.

This response displays little deviation from the upper and lower response curves. Plots for cavity heights of about 0.3 mm and about 0.2 mm are also depicted and are fairly consistent with the response of a naked microphone up to about 1800-2000 Hz. At higher frequencies, the microphone frequency responses at these cavity heights are still acceptable, since they fall generally within the upper and lower response curves. Regardless, the deviations depicted between about 2000 and about 6000 Hz may be compensated for adjusting speech processing parameters of the auditory prosthesis. At a cavity height of 0.1 mm, however, microphone frequency response falls off significantly from that of a naked microphone at very low frequencies. This may be due to contact occurring between the membrane and the microphone that interferes with the natural vibration of the membrane.

Simulated microphone frequency responses are depicted in FIG. 8B and are consistent with the tested responses depicted in FIG. 8A. The simulated responses are for cavities heights of 0.2 mm to 1.5 mm. A naked microphone frequency response is again depicted in the plot. Microphone frequency responses for cavity heights of 1.5 mm and 1.0 mm begin to deviate significantly from that of a naked microphone at around 2000 Hz. For a cavity height of 0.5 mm, significant deviation occurs around 4000 Hz. For a cavity height of 0.2 mm, significant deviation occurs around 5000 Hz. In general, the plots of FIGS. 8A and 8B indicate that smaller cavity heights may be more desirable to maintain a desirable microphone response, but too small of a height can cause significant response problems.

FIG. 9 depicts a comparison plot of frictional noise reduction between boots having differing structures. Frictional noise for an uncovered microphone and two covered microphones (with and without attenuated relief vents) are depicted. Boots utilizing attenuated relief vents are depicted in FIGS. 6A-6D. Note that for frequencies below 1000 Hz, the vented boot is actually less noisy than even the configuration where no boot is utilized. At almost all frequencies, the vented boot is significantly quieter than the non-vented boot. Non-vented boots are depicted in FIGS. 4A-5C.

FIG. 10 depicts a comparison plot of frictional noise differences between boots having differing structures. Frictional noise for an uncovered microphone is depicted as a reference. Additionally, frictional noise for suspended boots (e.g., those utilizing a collar, as described above) and non-suspended boots (e.g., those not utilizing a collar) is depicted. Note that at frequencies above about 700 Hz, the performance attendant with the suspended membrane configuration is comparable to that of an uncovered microphone configuration.

Figure 11:
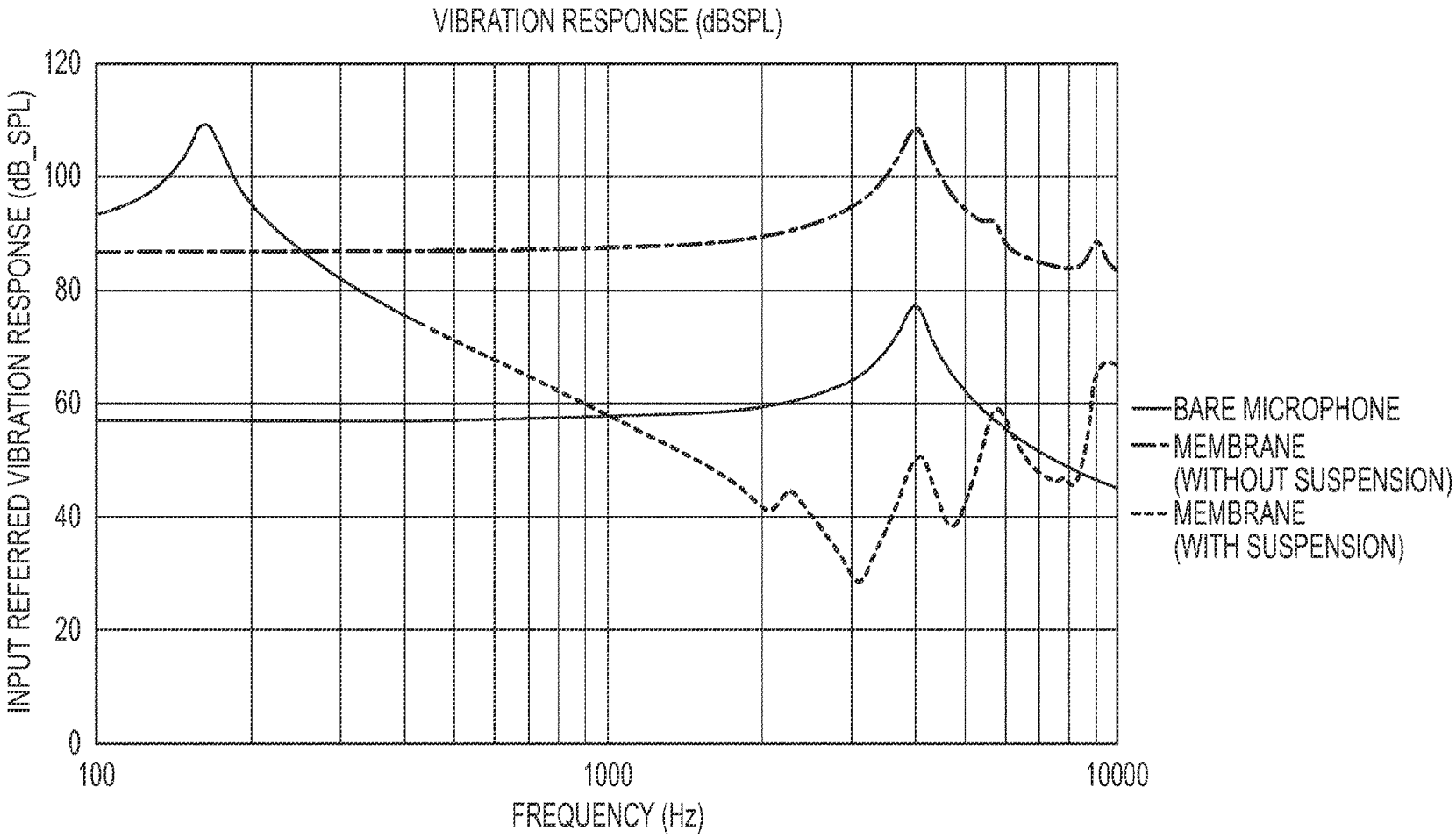
FIG. 11 depicts a comparison plot of vibration response differences between boots having differing structures.

FIG. 11 depicts a comparison plot of vibration response differences between boots having differing structures. Vibration response for an uncovered microphone is depicted as a reference. Above about 1000 Hz, the response of a suspended membrane will drop below, or be comparable to, the configuration that does not utilize a membrane.

Figure 12:
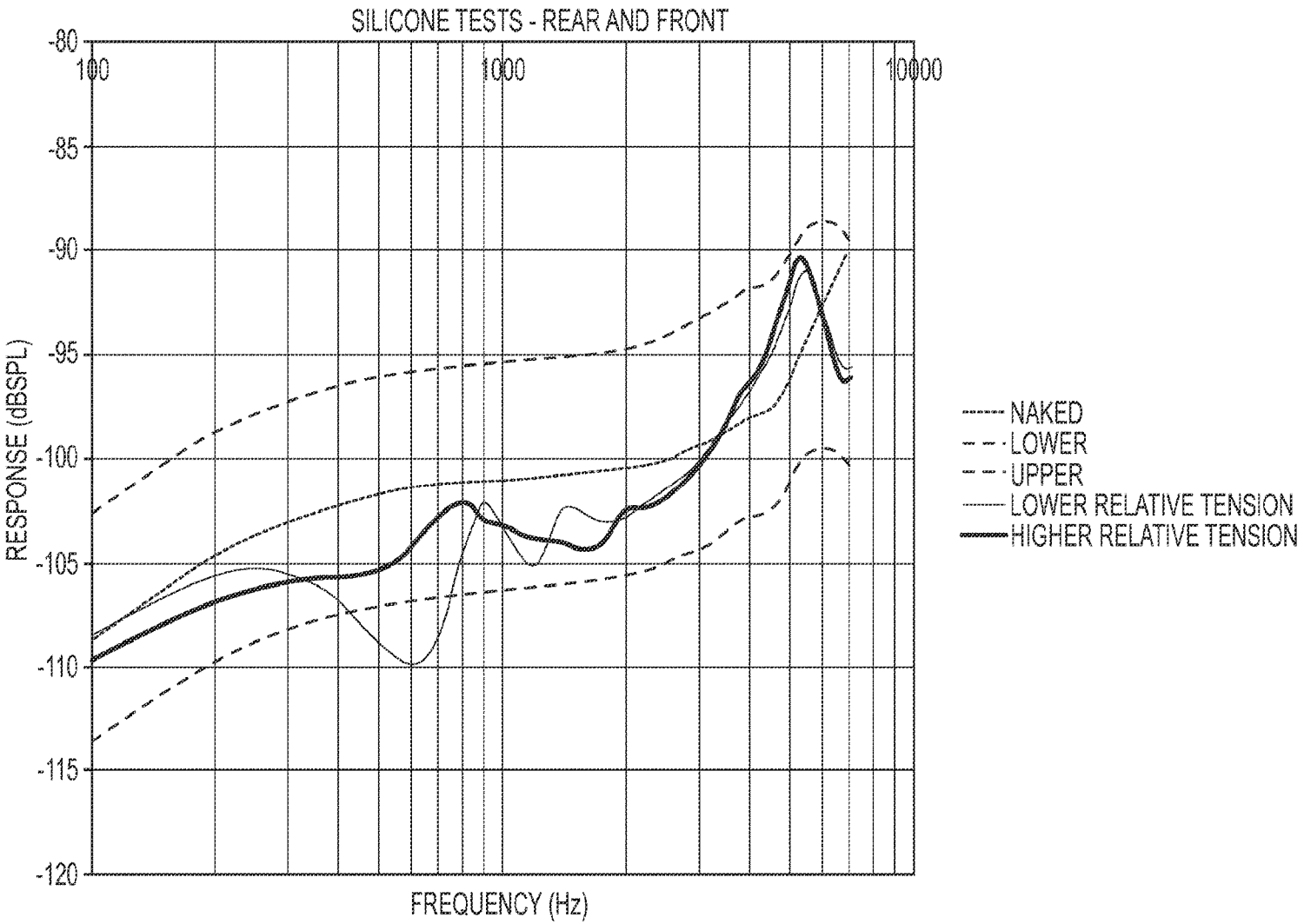
FIG. 12 depicts a comparison plot of acoustic response differences between boots having differing structures.

FIG. 12 depicts a comparison plot of acoustic response differences between boots having differing structures. The plot depicts results of a test where sheets of silicone having higher and lower relative tensions were installed over the front and rear microphones of an auditory prosthesis. In the plot, the upper curve depicts upper test system limits (i.e., the upper end of an allowed response for production devices), while the lower curve depicts lower test system limits (i.e., the lower end of an allowed response for production devices). The response for a naked microphone (e.g., a microphone not covered by a silicone sheet) is also depicted. The acoustic responses of higher and lower relative tension silicone sheets indicates a clear discrepancy in the response of the two types of sheets across a range of frequencies. Both the higher and lower relative tension sheets display a certain degree of tension (or conversely, sag), which effects the acoustic response of the microphone. This result indicates that the assembly variation inherent in the attachment of a thin membrane to a rigid carrier will lead to variation in acoustic performance. The unitary boots described herein, however, display acoustic responses similar to those of naked microphones. This may be due to the lack of sag in the face, due to the unitary molding of the boot, which is formed in tight tolerance to the outer dimensions of the microphone. The tight manufacturing tolerance helps reduce tensioning of the face during the assembly process.

The boots described herein can be manufactured of silicone or other resilient material, such as rubbers, thermoplastic elastomers, etc. Materials that provide water resistance without adversely effecting sound attenuation are particularly desirable. The silicone boot may be coated with one or more films or coatings to improve performance or increase operable life. Hydrophobic coatings may be particularly desirable, as are coatings that increase UV light resistance to prevent degradation of the boot. Known injection molding processes can be utilized in manufacture to obtain the required structure within appropriate tolerances. The boot may be a unitary structure or may be manufactured in multiple pieces (e.g., the sleeve, the face, and the flanges) that may be joined together with an appropriate adhesive.

The various embodiments of boots depicted herein are manufactured so as to further reduce attenuation of sound waves directed at the microphone, or reduce vibrations within the prosthesis housing. In one embodiment, the boot may be manufactured so as to limit stretching of the face when a microphone is inserted into the boot interior. Stretching of the face can attenuate sound, lead to more rapid degradation of the boot material, and make the face more susceptible to tearing. Thus, the boot can be manufactured in close tolerance to the outer dimensions of the microphone component to limit such stretching. Other embodiments, however, the boot may utilize a face that stretches, although it may be desirable to limit the degree of stretching, for at least the reasons described above. The auditory prostheses depicted herein utilize more than one microphone. The figures depict a discrete boot for each of the individual microphones. In certain embodiments, however, multiple boots may be integrated into a single part, which may increase ease of assembly. In general, attenuation is also reduced by molding the face of the boot so as to have a thickness less than the thickness of other parts of the boot. Additionally, a collar thickness (in embodiments utilizing a collar) of less than a flange or sidewall thickness helps reduce vibration transmission from the housing to the microphone. Relatively thick flanges, however, may be desirable to allow for significant compression between structural elements, to help ensure solid purchase of the boot within the housing. Sidewall thickness may be selected to accommodate component clearances or other criteria.

This disclosure described some embodiments of the present technology with reference to the accompanying drawings, in which only some of the possible embodiments were shown. Other aspects can, however, be embodied in many different forms and should not be construed as limited to the embodiments set forth herein. Rather, these embodiments were provided so that this disclosure was thorough and complete and fully conveyed the scope of the possible embodiments to those skilled in the art.

Although specific embodiments were described herein, the scope of the technology is not limited to those specific embodiments. One skilled in the art will recognize other embodiments or improvements that are within the scope of the present technology. Therefore, the specific structure, acts, or media are disclosed only as illustrative embodiments. The scope of the technology is defined by the following claims and any equivalents therein.

What is claimed is:

1. An apparatus comprising:

a housing defining an opening;

a microphone disposed within the housing proximate the opening, wherein a sound inlet of the microphone is oriented towards the opening; and a boot substantially surrounding the sound inlet of the microphone, wherein the boot comprises sidewalls and a face, wherein the sidewalls receive the microphone and wherein the boot further comprises a flange extending from at least one of the sidewalls, wherein the sidewalls comprise a sidewall thickness, the flange comprises a flange thickness, and the face comprises a face thickness;

wherein the face thickness is less than the sidewall thickness; and wherein the boot further comprises a collar connecting the flange to the at least one of the sidewalls, wherein the collar comprises a collar thickness less than the flange thickness.

2. The apparatus of claim 1, wherein the face is disposed proximate the sound inlet.

3. The apparatus of claim 1, wherein the face is disposed proximate the opening.

4. The apparatus of claim 1, wherein the face is disposed proximate the opening and the sound inlet.

5. The apparatus of claim 1, wherein an interior surface of the face and the sound inlet of the microphone are spaced apart to define a cavity.

6. The apparatus of claim 5, wherein at least one of the sidewalls at least partially defines a channel extending from an outer surface of the at least one of the sidewalls to an inner surface of the at least one of the sidewalls, thereby providing a fluidic connection between the cavity and an interior of the housing.

7. An apparatus comprising:

a boot comprising:

a sleeve;

a flange extending from the sleeve; and a face, wherein the face and the sleeve at least partially define a boot interior;

a microphone disposed within the boot interior; and a housing defining a housing interior and an opening, wherein the sleeve is disposed at least partially within the housing so as to inhibit ingress of contaminants into the housing interior via the opening, wherein the flange comprises a flange thickness and is connected to the sleeve at a collar, wherein the collar comprises a collar thickness less than the flange thickness.

8. The apparatus of claim 7, wherein the microphone is disposed within the boot interior and comprises a microphone inlet spaced from the face so as to define a cavity between the microphone and the face.

9. The apparatus of claim 8, wherein the boot at least partially defines a channel that places the housing interior and the cavity in fluidic communication.

10. The apparatus of claim 7, wherein the boot is suspended from the housing.

11. The apparatus of claim 7, wherein the collar at least partially defines a collar opening.

12. The apparatus of claim 7, wherein the housing defines a structure that mates with the boot.

13. The apparatus of claim 12, wherein the structure comprises a holding structure configured to hold the flange, thereby holding the boot in place.

14. An apparatus comprising:

a sleeve comprising a sleeve thickness;

a face integral with the sleeve, wherein the face and the sleeve at least partially define an interior, and wherein the face comprises a face thickness less than the sleeve thickness;

a flange extending from the sleeve and comprising a flange thickness; and a collar connecting the flange and the sleeve, wherein the collar comprises a collar thickness less than the flange thickness.

15. The apparatus of claim 14, wherein the flange comprises two flanges disposed on opposite sides of the sleeve.

16. The apparatus of claim 14, wherein the collar at least partially defines an opening, and wherein the sleeve at least partially defines a channel.

17. The apparatus of claim 14, comprising a microphone, wherein a space is defined between the microphone and the face.

18. The apparatus of claim 14, wherein the sleeve comprises a plurality of sidewalls.

19. An apparatus comprising:

a boot comprising:

a sleeve;

a flange extending from the sleeve; and a face, wherein the face and the sleeve at least partially define a boot interior;

a microphone disposed within the boot interior; and a housing defining a housing interior and an opening, wherein the sleeve is disposed at least partially within the housing so as to inhibit ingress of contaminants into the housing interior via the opening;

wherein the housing defines a structure that mates with the boot; and wherein the structure comprises a holding structure configured to hold the flange, thereby holding the boot in place.

20. The apparatus of claim 19, wherein the boot comprises sidewalls having a sidewall thickness; wherein the face comprises a face thickness; and wherein the face thickness is less than the sidewall thickness.

21. The apparatus of claim 19, wherein the flange is connected to the sleeve at a collar.

* * * * *